US005274856A

United States Patent [19]

Bernard et al.

[11] Patent Number: 5,274,856

[45] Date of Patent: Jan. 4, 1994

[54] PORTABLE HYGENIC APPARATUS

[75] Inventors: Louise Bernard, Montreal; Claude Le Myre, Laval, both of Canada

[73] Assignee: Les Placements Jean-Claude Lemyre Inc., Laval, Canada

[21] Appl. No.: 935,280

[22] Filed: Aug. 26, 1992

[51] Int. Cl.[5] ..... A61H 35/00

[52] U.S. Cl. ..... 4/420.4; 4/447

[58] Field of Search ..... 4/420.1, 420.2, 420.4, 4/443, 444, 447, 448

[56] References Cited

U.S. PATENT DOCUMENTS

| | | | |
|---|---|---|---|
| 1,992,132 | 2/1935 | Spicher | 4/420.1 X |
| 3,310,813 | 3/1967 | Jonsson | 4/448 |
| 3,430,268 | 3/1969 | Zoberg | 4/420.1 |
| 3,602,921 | 9/1971 | Umann et al. | 4/448 |
| 4,287,618 | 9/1981 | Silver | 4/420.2 X |
| 4,383,339 | 5/1983 | Miller | 4/420.4 X |

FOREIGN PATENT DOCUMENTS

| | | | |
|---|---|---|---|
| 418997 | 2/1967 | Switzerland | 4/420.4 |

*Primary Examiner*—Charles E. Phillips

*Attorney, Agent, or Firm*—Pierre Lespérance; Francois Martineau

[57] ABSTRACT

The portable apparatus comprises an elongated body adapted to be mounted on a toilet seat and including a stem terminated by an upwardly-directed nozzle adapted to be located in the center of a toilet bowl and below the rim thereof. A clamp is releasably secured to the toilet seat. A spring-biased pin connects the body to the clamp while allowing pivotal and longitudinal movement of the body with respect to the clamp. A handle carried by the body enables the user, while seated on the toilet seat, with the apparatus between the user's legs, to pull the body upwardly and adjust its longitudinal and pivotal positions with respect to the clamp and, consequently, the nozzle can be adjusted both in orientation and in back-and-forth position with respect to the seated user. A blocking device maintains the body in adjusted position upon release of the handle. The apparatus further includes a bottle for containing a liquid refresher or a medicament to be mixed with the water. Two diverter valves are provided for discharging the water from the faucet directly into the sink or into the toilet bowl when the nozzle and bottle are not used. A cannula can be attached to the nozzle through a flexible nipple.

14 Claims, 6 Drawing Sheets

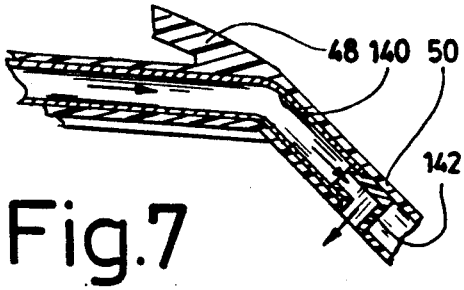
Fig.7
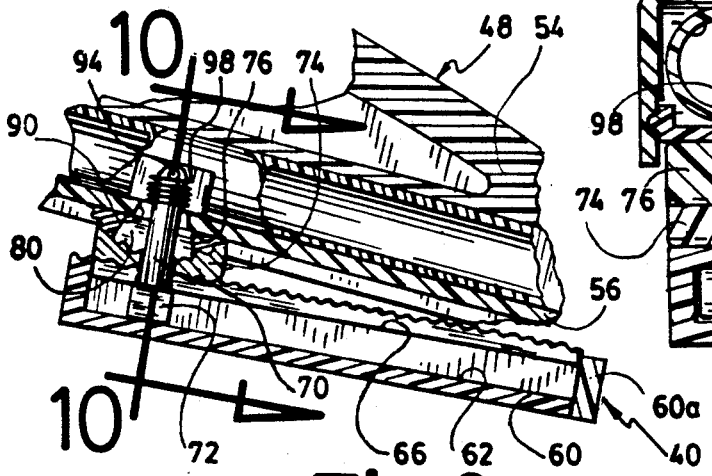
Fig.9
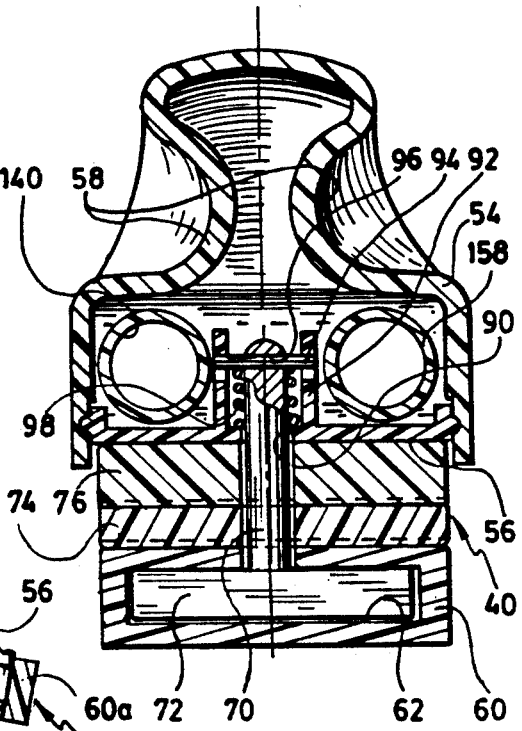
Fig.10
Fig.11
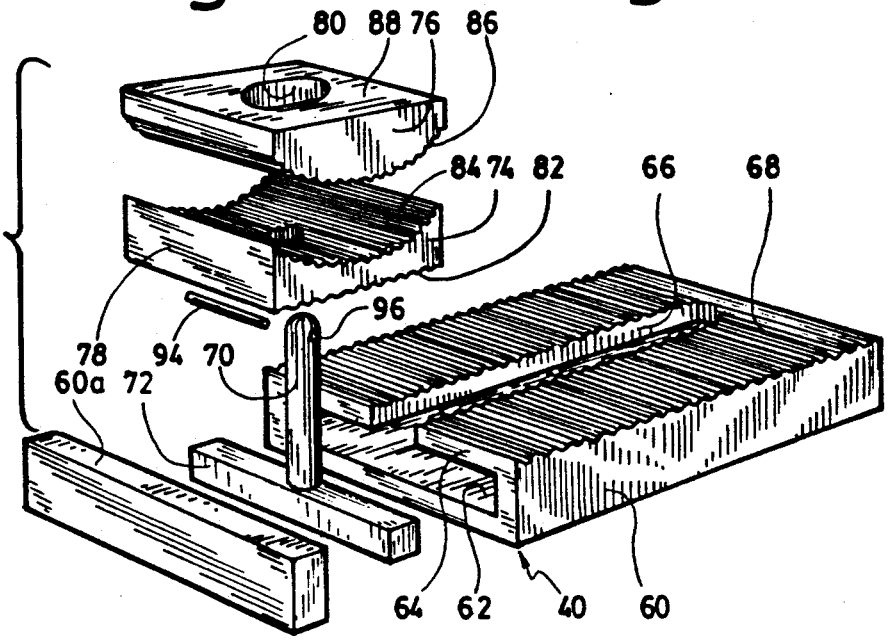

14
14
170
176
174
172
184
168
52
22
164
166
54
186
24
26
182
160
180
56
158
50
178

PORTABLE HYGENIC APPARATUS

FIELD OF THE INVENTION

The present invention relates to a portable hygienic apparatus adapted to be removably installed on a toilet bowl for use in spraying the perineal region of a user, seated on a toilet seat or on a toilet bowl for medicinal, therapeutic or cleansing purposes.

BACKGROUND OF THE INVENTION

Systems of the prior art for use in combination with a toilet bowl and seat, do not provide proper positioning of the nozzle by the user while the latter is seated on the toilet seat. Moreover, none of the prior art systems of the character described provide for vertical adjustable orientation of the nozzle to suit the user's requirement and/or are suited for use with a cannula.

OBJECTS OF THE PRESENT INVENTION

The general object of the present invention is to provide a portable hygienic apparatus adapted to be used in conjunction with a conventional toilet bowl and seat, the nozzle of which can be adjustably positioned both and along the longitudinal axis of the perineal region, that is along the anal vaginal axis of the user, and also in vertical orientation by the user herself while seated on the toilet by pulling on an apparatus handle disposed between the user's legs.

Another object of the present invention is the provision of a portable apparatus of the character described, provided with means for the user to easily sense the water temperature and pressure prior to feed the water to the nozzle.

Another object of the present invention is to provide a system of the character described, in which a cannula may be used and which can be easily oriented in proper position by the user.

Another object of the present invention is to provide a portable apparatus of aesthetic and inexpensive construction, which may be releasably secured to toilet seats of various cross-sectional shapes and which can be easily stored away when not in use.

Another object of the present invention is to provide a portable apparatus of the character described, which can be installed on any conventional toilet without modification either to the toilet bowl or to the toilet seat.

Yet another object of the present invention is to provide a portable apparatus of the character described, in which the jet pressure issuing from the nozzle can be easily adjusted by the user prior to taking a seated position.

Another object of the present invention is to provide an apparatus of the character described, having a bottle for containing a liquid refresher, a medicament of the like to be mixed with water, the bottle being removable for cleaning and replenishing and also having an internal partition with passages to provide efficient mixing of the refresher or medicament with the water.

Another object of the present invention is to provide hygienic apparatus in which the water circuit is never under the full water pressure of the water supply, thereby enabling the use of less expensive, thinner wall, tubing than would otherwise be required.

SUMMARY OF THE INVENTION

The portable hygienic apparatus of the invention comprises an elongated body provided with an upwardly-directed nozzle at one end and a water inlet port at its other end. A handle is formed on the body. A resilient clamp is adapted to be releasably clamped around a toilet seat and a connector pin connects the body to the clamp, while allowing upward separating movement of the body, together with pivotal and longitudinal movement of said body with respect to the clamp. A spring biases the body downwardly toward the clamp and a blocking system blocks the body in adjusted position when the body is pressed against the clamp by the spring. Therefore, a person seated on the toilet seat with apparatus between the person's legs can manually pull the body upwardly by the handle against the bias of the spring to adjust the longitudinal position and the vertical orientation of the body with respect to the clamp and, thus, with respect to the user. Release of the body allows the spring to automatically bring the body into a blocked adjusted position. Preferably, a hollow block is secured on top of the clamp and defines a chamber and has a top wall provided with a longitudinal slot in communication with the chamber. The connector pin extends through the slot and has at its lower end a transverse retaining member located in the chamber. The pin is shiftable along the slot and the upper end of the pin is pivotally connected to the body. The top planar surface of the hollow block is serrated transversely of the slot. A pair of stacked blocks surround the pin intermediate the body and the hollow block. The lower surface of the lower stacked block is flat and is planar and serrated to engage the serrations of the hollow block. The top surface of this lower block, together with the lower surface of the upper block, are generally cylindrical and mating and are provided with mutually-engageable serrations. The upper block is secured to the underside of the body. The spring extends between the body and the top end of the pin.

Preferably the body includes a top and a bottom molded section, made of synthetic resin, and the handle is formed by opposite recesses made in the sides of the top section. The body includes a main portion overlying and disposed astrides of the clamp and a downwardly-extending stem portion terminated by an upwardly-directed nozzle which is located substantially centrally and below the rim of the toilet bowl. A bottle, for containing liquid soap, a medicament or the like, to be mixed with water, is removably attached to the body and depends therefrom on the outside of the toilet bowl. The bottle has an inside central partition with at least two vertically spaced liquid passages for efficient mixing. The apparatus inlet is adapted to be connected to a regular faucet by means of a faucet connector and flexible tubing. A first diverter valve is mounted in said tubing to divert water directly into the sink. A second diverter valve is mounted in the body upstream of the mixing bottle and is provided with a tubing extending through the body and opening in the stem thereof to divert and discharge water directly into the toilet bowl, whenever the apparatus nozzle is not used. The apparatus nozzle can be fitted with a cannula through the agency of a flexible nipple to permit further precise orientation of the cannula.

BRIEF DESCRIPTION OF THE DRAWINGS

FIG. 7 is a partial section, taken along line 7—7 of FIG. 3;

FIG. 9 is an enlarged section of the area in circle 9 of FIG. 6A and showing the means connecting the apparatus body to the clamp;

FIG. 10 is a cross-section taken along line 10—10 of FIG. 9;

FIG. 11 is an exploded perspective view of the different parts forming the connector means shown in FIGS. 9 and 10;

DETAILED DESCRIPTION OF THE PREFERRED EMBODIMENT

Figure 1:
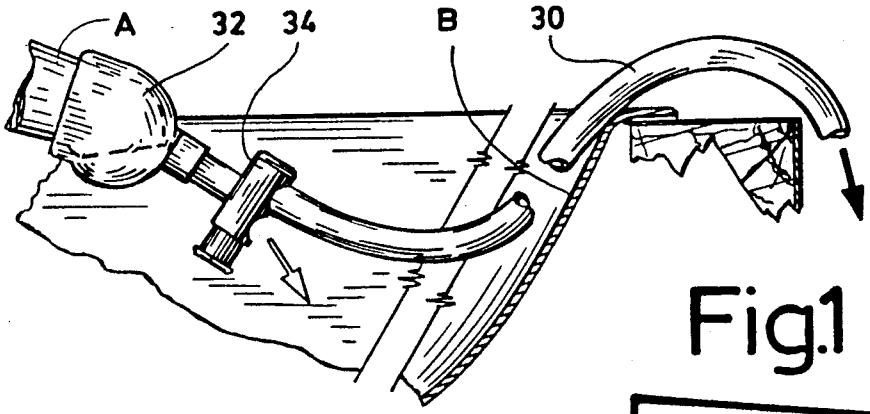
FIG. 1 is a partial cross-section of a bathroom sink and showing the water-feeding tube of the apparatus connected to the sink faucet.
Figure 2:
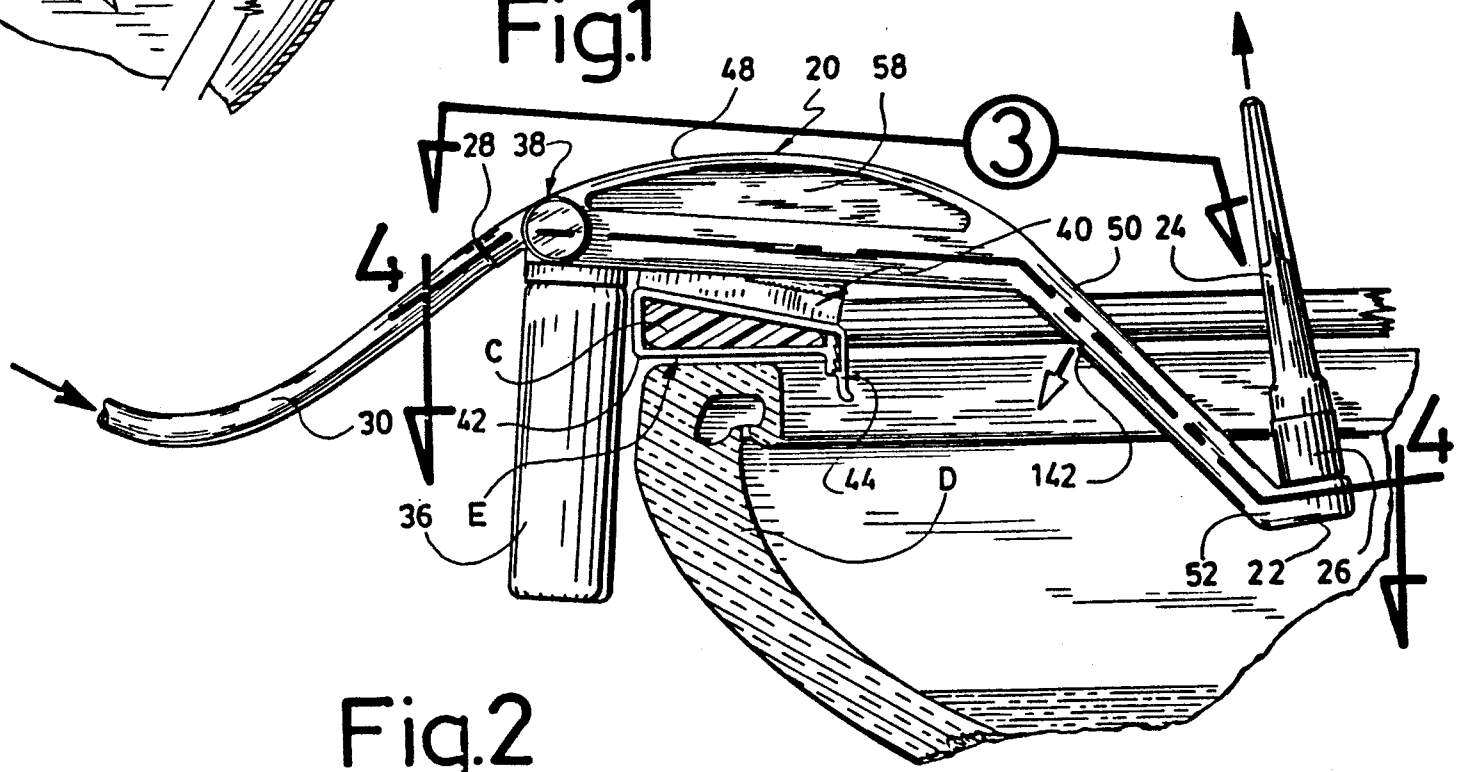
FIG. 2 is a partial cross-section of a toilet bowl and seat and showing the portable apparatus of the invention secured in operative position to the toilet seat and also showing part of the water-feeding tube.
Figure 3:
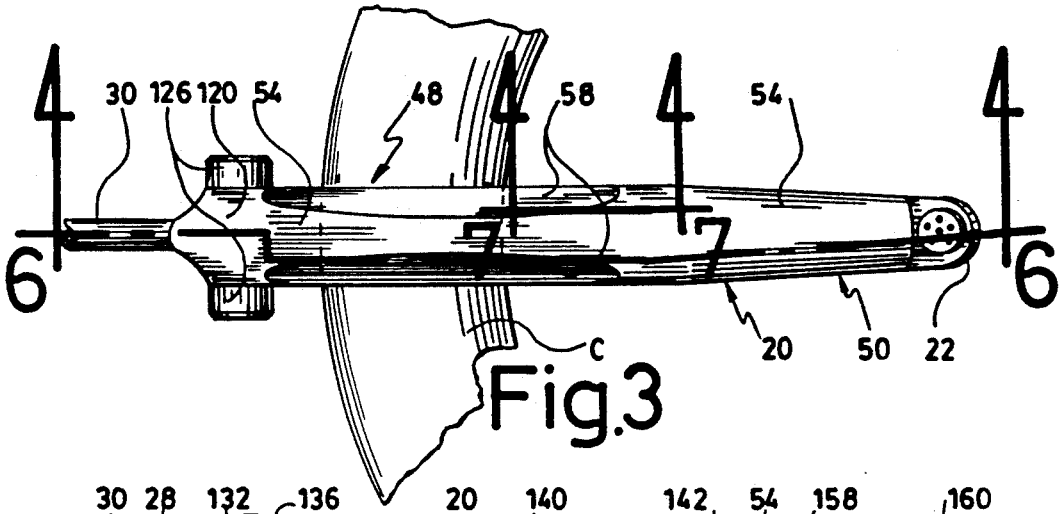
FIG. 3 is a top plan view in accordance with line 3 of FIG. 2.

Referring to FIGS. 1 and 2, the portable hygienic apparatus device generally comprises an elongated body 20, having a nozzle carrying end 22, which is in communication with a cannula 24 through the intermediary of a flexible nipple 26. The body 20 has an inlet port 28 to which is attached a flexible water-feeding tube 30, the other end of which is attached to a faucet connector 32 adapted to be fitted over a faucet A of a bathroom sink B, being preferably a mixed cold and hot water faucet, that is a faucet provided with means to adjust the temperature of the water discharged therefrom. A first diverter valve 34 is series connected in the feeding tube 30. A mixing bottle 36 is attached to the underside of the body 20 and extends on the exterior of the toilet seat C and toilet bowl D. A second diverter valve 38 is carried by the body 20 just upstream of the bottle 36.

The body 20 is adjustably carried by a mounting system 40 on top of a flexible resilient clamp 42 (FIGS. 1 and 6), which is adapted to surround the toilet seat C and be adjustably fixed thereto by means of a pawl tooth 44 adjustably engageable with a selected one of the ratchet teeth 46 formed at the opposite end of the strip-like clamp 42. The clamp can fit and be secured around toilet seats of various cross-sectional shapes and thicknesses. The clamp will be modified to fit directly the rim of a toilet bowl in the absence of a toilet seat.

Body 20 comprises a main body portion 48, which overlies and is astride of the clamp 42, so that it extends outwardly of the toilet seat and bowl and inwardly of the toilet seat, as clearly shown in FIG. 2. The main body portion 48 is extended by a downwardly-directed stem portion 50 and terminated by an upwardly-inclined end portion 52, which carries the nozzle and the cannula 24.

As clearly shown in FIGS. 2 and 10, the body 20 is formed by the inter-engagement of two molded parts made of synthetic resin, namely: a top-molded section 54 and a bottom-molded section 56. Bottom section 56 is substantially transversely flat throughout its length, while the top section 54 is of generally inverted U shaped cross-section and the side legs thereof are inwardly recessed to form two laterally-opposite recesses 58 serving as a handle by which the apparatus body 20 can be manually grasped and upwardly pulled by a person seated on the toilet seat, with the body and its handle located between the person's legs.

Referring to FIGS. 9, 10, and 11, the mounting bracket 40 comprises an elongated hollow block 60 defining a chamber 62 closed at both ends of the block by the block itself and by a closure 60*a* fixed to the block. Block 60 is secured at its underface to the top of the clamp 42 and its top wall 64 is provided with a longitudinally-extending slot 66. The top face of the top wall 64 is formed with a plurality of serrations 68 extending transversely of the slot 66. A connector pin 70 upwardly extends through the slot 66 and its lower end is secured to the centre of a transversely-extending retaining member 72 located within chamber 62 and retaining the connector pin 70 while allowing the same to slide longitudinally of the slot 66. A pair of stacked blocks 74, 76 receive connector pin 70 through their holes 78, 80, respectively. Hole 80 is elongated. The lower face of the lower block 74 is planar, as the top face of the top wall 64, and is also provided with a plurality of transversely-extending serrations 82 mating with the serrations 68 of hollow block 60. The upper face of the lower block 74 is concave transversely of the serrations 82 and this concave upper face is provided with transversely-extending serrations 84. The upper block 76 has a convex lower face provided with serrations 86 and this convex lower face has the same radius of curvature as the upper face of the lower block, so that the two faces and their serrations are adapted to mate and interengage. The top flat face 88 of the upper block 76 is secured to the underside of the bottom section 76 of the main body portion 48. Connector pin 70 extends upwardly beyond the upper block 76, freely enters through an elongated hole 90 made in the bottom section 56 and the upper end of the connector pin 70 extends between and is attached to the pair of upstanding ears 92 of the body bottom section 56 by means of an attachment pin 94 frictionally fitted into a transverse hole 96 of connecting pin 70 and engaging holes made in the ears 92. A compression coil spring 98 surrounds the upper portion of connector pin 70 and acts against attachment pin 94 and against bottom body section 56 around hole 90.

As shown in FIG. 2, the stem portion 50 of the body 20 extends downwardly within the toilet bowl D with its end portion 52 disposed below the rim E of the bowl and in the central portion of said bowl. The user, while seated on seat C and facing the main body portion 48, can easily grasp handle 58 between her legs and pull body 20 upwardly against the action of the coil spring 98, so as to release the inter-engagement of both sets of serrations, namely: serrations 68 of hollow block 60 and the lower serrations 82 of the lower block 74, which constitute one set of serrations, and the upper serrations 84 of the lower block 74 with the serrations 86 of the upper block 76, which constitute the second set of serrations. Thus, the body 20 is free to be moved back and forth longitudinally of the slot 66 and also to pivot in a vertical plane about a pivot axis constituted by the attachment pin 94. Thus, the nozzle carrying end portion 52 can be adjusted up and down and back and forth along the anal vaginal axis of the user. Upon release of the handle 58, compression spring 98 returns the body 20 towards the clamp 42 and the two sets of serrations become in mutual inter-engagement to block the apparatus body 20 in adjusted position.

Proper lateral positioning of the nozzle-carrying end portion 52 of the body 20 is achieved by slight rotation of the clamp 42 with respect to the toilet seat C.

It is to be noted that the clamp 42, as shown, is adapted to be used in combination with a toilet seat forming a closed figure. However, clamp 42 can be easily modified, namely made wider, to fit around the two free end portions of a U-shape toilet seat and bridge the front gap of the latter.

Figures 6, 6A, 8, 8A:
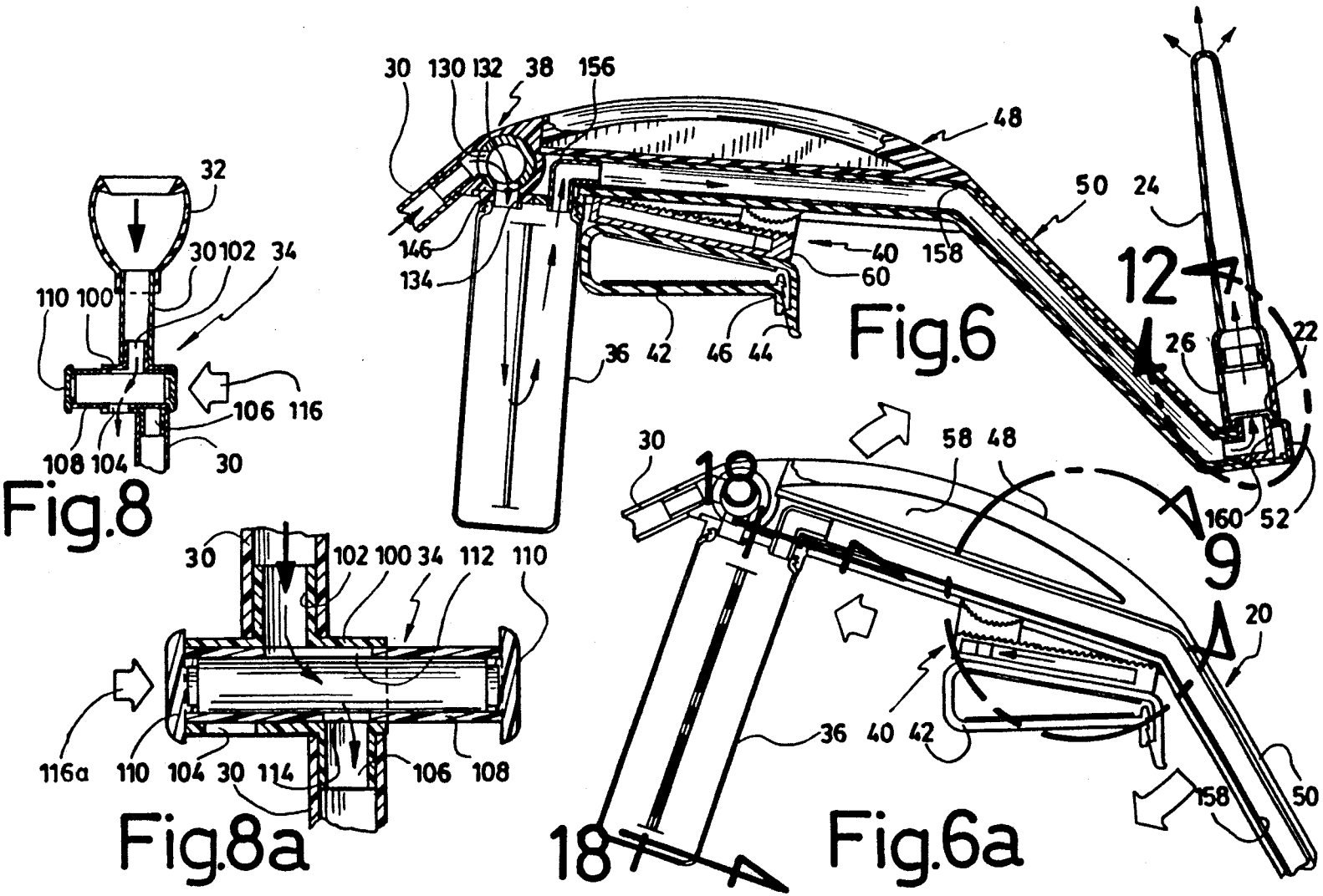
FIG. 6 is a longitudinal section of the apparatus, taken along line 6—6 of FIG. 3.
FIG. 6A is a diagrammatic view, similar to that of FIG. 6, but showing another adjusted position of the portable apparatus relative to the toilet bowl and seat.
FIG. 8 is a longitudinal section of the faucet connector and of the first diverter valve in water-diverting position.
FIG. 8A shows the first diverter valve in section and in nozzle feeding position.

Referring to FIGS. 1, 8, and 8A, the faucet connector 32 is of standard construction, being preferably made of rubber, and the first diverter valve 34 is a push-button valve comprising a cylindrical body 100, having one inlet port 102 and two laterally-disposed outlet ports 104, 106. Outlet port 104 freely discharges to the exterior, while outlet port 106 is connected to feeding tube 30 as well as the inlet port 102. A cylindrical, hollow valve member 108 is axially movable within the cylindrical body 100. The hollow valve member 108 is fitted with two end caps 110, which determine the two limit positions of the valve member 108 by abutting against the respective ends of body 100. Valve member 108 has an elongated inlet hole 112 in constant communication with inlet port 102. Valve member 108 further has an outlet hole 114 which selectively communicates with the desired one of the two outlet ports 104, 106 in the respective limit positions of the valve member 108.

FIG. 8 shows that by pushing the valve member 108 in accordance with arrow 116, the water is discharged directly into the sink B through water diverting part 104. FIG. 8A show that by pushing the valve member 108 in the opposite direction 116*a*, the water coming from the faucet A is directed through port 106 into the feeding tube 30 and into the body 20.

FIGS. 3 to 6 show the construction of the second diverter valve 38. Its valve body, indicated at 120, is integral with the apparatus body 20 adjacent and just downstream from the inlet port 28. This valve body 120 defines a cylindrical cavity in which is rotatably mounted a cylindrical hollow valve member 124 axially retained in the cavity of valve body 120 by end caps 126.

Valve member 124 has two centrally located holes 130, 132 at right angles to each other and a laterally offset outlet hole 133 diametrally opposite hole 130. In one rotated position of the valve member 124, as shown in FIGS. 5 and 6, hole 130 is the inlet in alignment with inlet port 128 while hole 132 is an outlet in alignment with a first outlet port 134 of the valve body 120, and this outlet port 134 is in direct communication with the top of the mixing bottle 36. Outlet hole 133 is shut off by valve body 120. In a second or water-diverting position of the valve member 124, hole 130 is shut off by valve body 120, hole 132 becomes the inlet while outlet hole 133 comes in communication with a second outlet port 136, shown in FIG. 4 and 5A. Rotation of the valve member 134 is effected in accordance with the arrow 138, shown in FIG. 5A.

Figure 4:
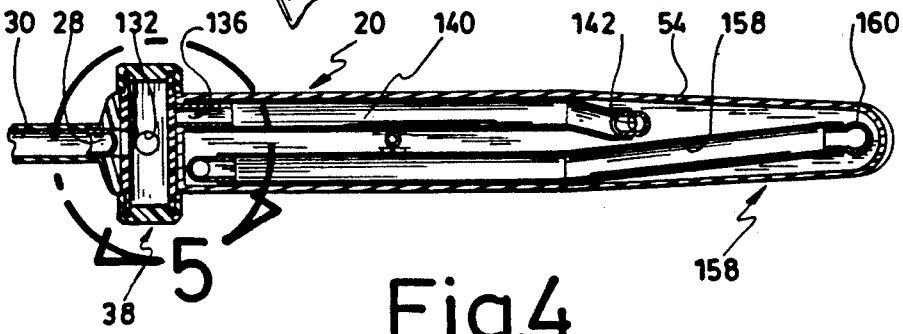
FIG. 4 is a planar, taken alone line 4—4 of FIG. 2.
Figure 5:
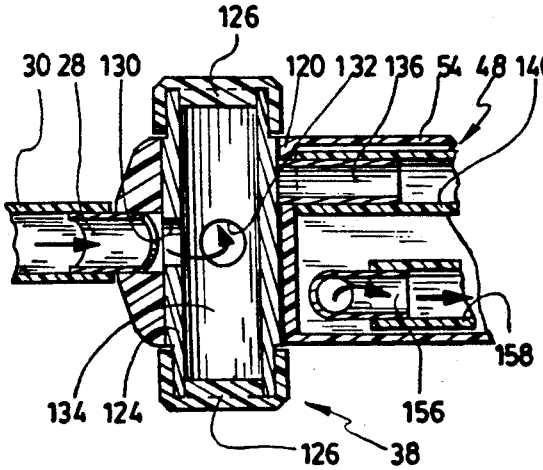
FIG. 5 is an enlarged section of the second diverter valve in nozzle feeding position and taken in area 5 of FIG. 4.
Figure 5A:
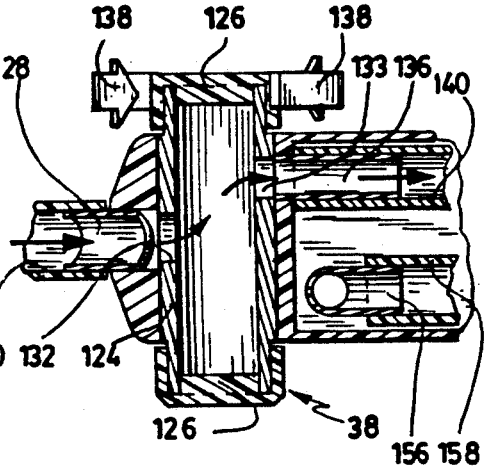
FIG. 5A is a view of the second diverter valve as shown in FIG. 5 but in its water-diverting position.

The second outlet port 136 is in communication with a flexible tube 140 which extends within the main body portion 48 and partly within the stem portion 50 where, as shown in FIGS. 2 and 4, it is connected to an elbow nipple 142 which constitutes an outlet port, whereby the water can be directly discharged into the toilet bowl D in a downwardly-directed jet.

In the first position of the second diverter valve 38, as shown in FIGS. 5 and 6, the water is discharged directly into the mixing bottle 36, where it can be mixed, if so desired, with a solution of a medicament or a liquid soap before being fed to the nozzle.

Mixing bottle 36, which is shown in FIGS. 2, 6 and 18 to 21, is preferably made of synthetic resin by a blow-molding process. It has an externally-threaded neck 144 to be releasably connected to the underside of the body 20 by means of inwardly-threaded circular skirt 146 of the latter. Bottle 36 is formed with oppositely-directed recesses 148 in such a manner that opposite portions of the lateral walls of the bottle are fused together at vertically-spaced zones 150, while the intermediate side wall portions remain spaced from each other to define transverse passageways 152 interconnecting the two opposite chambers 154 formed in the bottle by the transverse partition produced by the junction zones 150.

A good mixing of the water with a liquid solution is achieved, and this mixture is discharged through the neck 144 into an elbow nipple 156 and a flexible tube 158 located within body 20. Tubing 158 extends the whole length of the body 20 and communicates at its outer end with an elbow nipple 160 located in the end portion 52 of the body 20 and in communication with the nozzle 22. (See FIGS. 6 and 12 and 13 Nozzle 22 is formed by the top section 54 of the body 20 at the end portion 52 and includes a cylindrical boss forming a flat top wall provided with a central circular discharge hole 164 and a plurality, for instance four, of elongated discharge holes 166 disposed along a circle, the centre of which is co-axial with central hole 164. Nozzle 22 has two opposite lateral grooves 168.

Figures 12, 13, 14, 14A, 15, 16, 17:
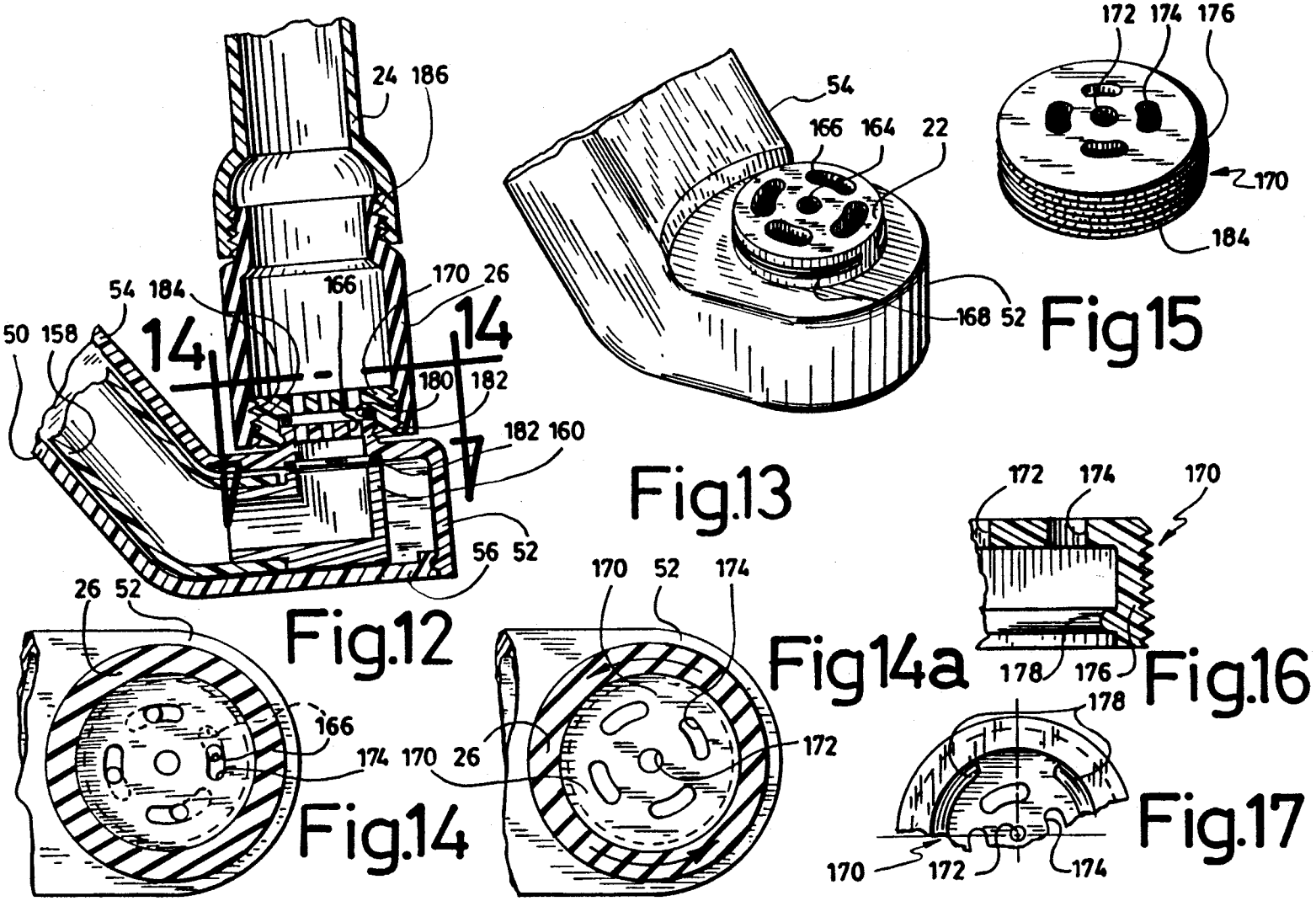
FIG. 12 is a longitudinal section of the nozzle-carrying end of the body and showing the nozzle, the lower part of the cannula and the nipple connecting the cannula to the nozzle.
FIG. 13 is a partial perspective view showing the nozzle.
FIGS. 14 and 14A are plan sections taken along line 14—14 of FIG. 12 and showing the nozzle cap in two limit adjusted positions.
FIG. 15 is a perspective view of the adjustable nozzle cap.
FIG. 16 is a partial cross-section of the nozzle cap.
FIG. 17 is a partial bottom plan view of the external nozzle cap.
Figure 20:
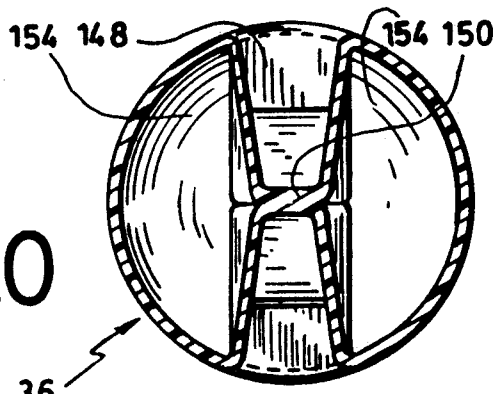
FIGS. 20 and 21 are plan sections taken along lines 20—20 and 21—21, respectively, of FIG. 19.
Figure 21:
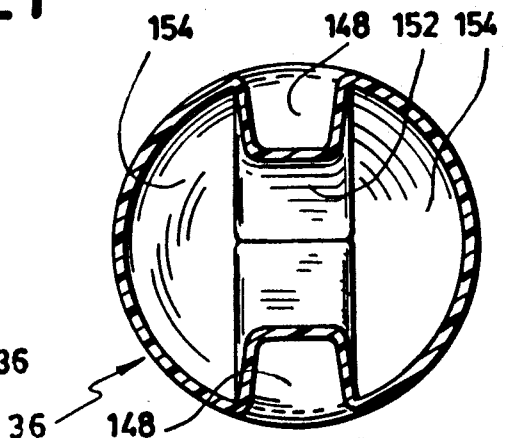
Figure 19:
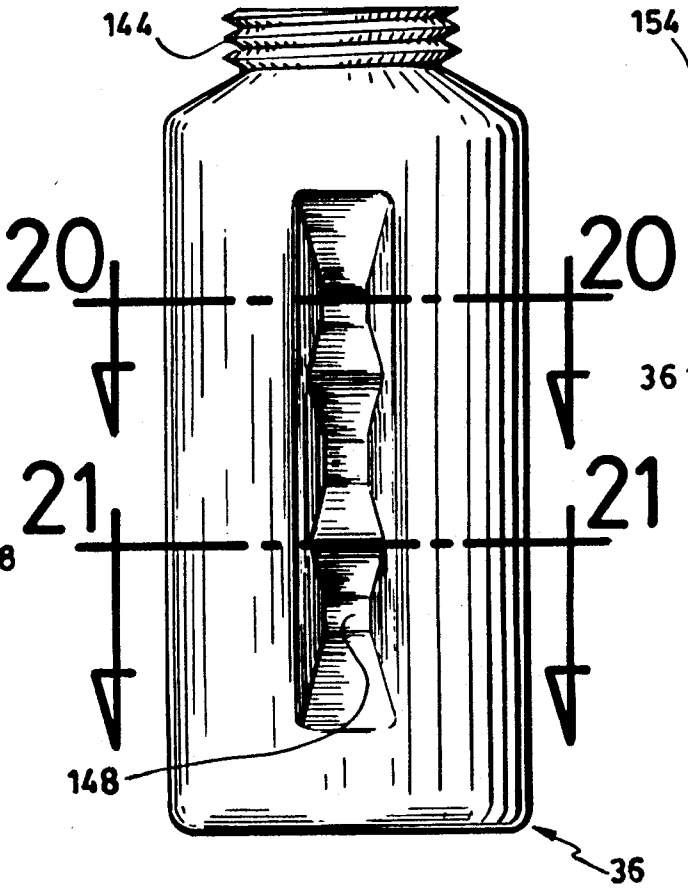
FIG. 19 is a side elevation of the bottle.
Figure 18:
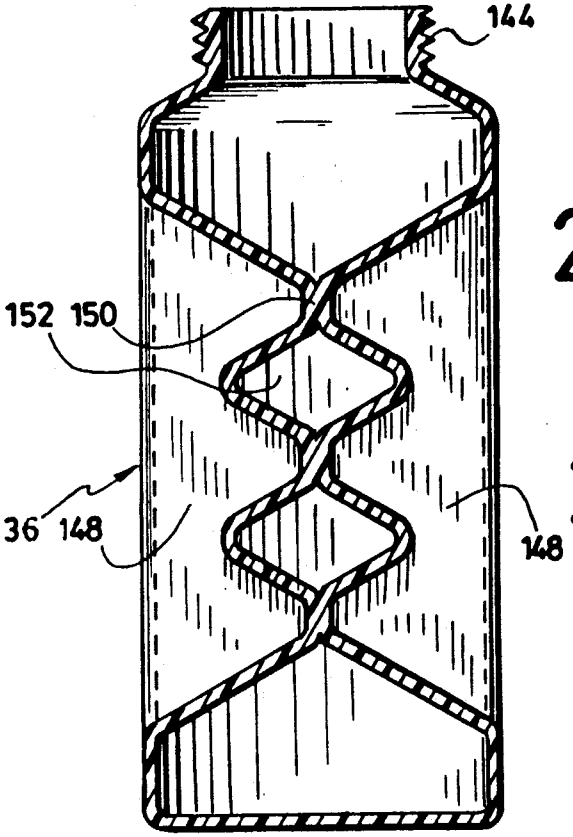
FIG. 18 is a longitudinal section of the mixing bottle.

A nozzle cap 170 is also provided with a central hole 172 and a series of elongated holes 174. Cap 170 has a skirt 176 internally provided with a pair of ribs 178 snapped into the respective grooves 168 and allowing rotation of the cap 170 with respect to the nozzle 22 between two limit positions, namely a fully-open position as shown in FIG. 14A in which the two sets of elongated holes 166, 174 are in complete register for a maximum water discharge and the limit position shown in FIG. 14 in which only the end parts of the elongated holes 166, 174 are in register for a minimum water discharge.

Preferably, an O-ring 180 is located between nozzle 22 and the inside of cap 170 for liquid tightness of the joint between these two parts. Similarly, outlet nipple 160 is made fluid tight with nozzle 22 and also is held in position by being pushed by bottom body section 56 against an O-ring 182 which in turn is pressed against the inside face of the top body section 54 around the inlet hole of the nozzle 22.

The nozzle 22 can be used just as described or it can be fitted with the flexible nipple 26 by itself or with the further addition of the cannula 24. The nipple 26 is preferably made of elastomeric material, such as rubber, and is inwardly threaded at one end on the external threads 184 of the skirt 176 of the cap 170. The upper end of the nipple 26 has external threads for removable threaded engagement with the internal threads 186 at the lower end of the cannula 24. The latter is of standard construction and can be easily directly handled by the user to the proper final orientation. If only nipple 26 is used, the water inlet issuing from nozzle 22 can be also oriented by the user.

The faucet valve can be adjusted to the required temperature by the user feeling the water discharged into sink D by the first diverter valve 34 or the water discharged in bowl D at outlet 142 by the second diverter valve 38. The final nozzle output can be adjusted by rotating the nozzle cap 170 to the desired position. Discharge of the nozzle 22 is started and stopped by simple rotation of the valve member of the second diverter valve 38. When nozzle 22 is not operating, there is no pressure built up within the flexible tubings 30, 15B, since the water is directly discharged into the toilet bowl D by the second diverter valve 38. Therefore, the tubing 30, 140, 158 need not resist the full water pressure of the public water supply.

The water always circulates through the mixing bottle 30, even if the latter is not used for soap or a medicament.

We claim:

1. A portable hygienic apparatus comprising an elongated body having a first and a second end, a nozzle carried by said first end, a water inlet port at said second end, a handle portion formed on said body, releasable clamping means adapted to be releasably clamped to a toilet seat, means for mounting said body on said releasable clamping means, said means for mounting allowing upward separating movement of said body from said clamping means so as to allow pivotal and longitudinal movements of said body relative to said clamping means, said means for mounting including spring means biasing said body downwardly towards said clamping means and releasable blocking means blocking, under the bias of said spring means, said body to said clamping means in adjusted pivoted and longitudinal positions relative to said clamping means, said blocking means being releasable by manually pulling said body away from said clamping means by grasping said handle to effect said separating movement against the bias of said spring means.

2. A portable apparatus as defined in claim 1, wherein said means for mounting includes a hollow block secured on top of said clamping means, said block defining a chamber and having a top wall provided with a longitudinal slot in communication with said chamber, an upstanding connector pin extending through said slot, a transverse retaining member fixed to the lower end of said pin and located in said chamber, said pin shiftable along said slot, the upper end of said pin pivotally connected to said body, said spring means acting on the upper end of said pin and on said body; and said blocking means including a pair of stacked lower and upper blocks surrounding said pin intermediate said body and said hollow block, said lower block and the top wall of said hollow block having mutually-abuttable planar frictional faces, the lower face of said upper block and the upper face of said lower block being mutually-abuttable and mating curved frictional faces, said upper block being secured to the underside of said body.

3. A portable apparatus as defined in claim 2, wherein said frictional faces are serrated faces with the serrations extending transverse to the longitudinal axis of said slot and parallel to the generatrix of said curved faces.

4. A portable apparatus as defined in claim 1, wherein said body includes a bottom and a top molded section made of synthetic resin, assembled together and forming a hollow body, said handle portion including laterally-opposite recesses made in the sides of said top section.

5. A portable apparatus as defined in claim 1, wherein said body includes a main portion overlying and astride said clamping means, and a downwardly-extending stem portion terminated by an upwardly-inclined end portion defining said first end and located substantially, centrally and below the rim of said toilet bowl when said body is clamped in operative position by said clamping means.

6. A portable apparatus as defined in claim 5, wherein said body is hollow, said handle portion including laterally-opposite recesses made in the sides of said main portion; and further including a first tubing extending within said body and connected to and establishing communication between said nozzle and said water inlet port.

7. A portable apparatus as defined in claim 6, further including a bottle releasably secured to and dependent from said body main portion intermediate said second end and said clamping means, and located externally of said toilet bowl, in the operative position of said apparatus, said bottle series connected between said water inlet port and said flexible tubing.

8. A portable apparatus as defined in claim 7, wherein said bottle includes an integral internal partition separating the bottle into two compartments, said partition having at least two vertically-spaced passages intercommunicating the two compartments.

9. A portable apparatus as defined in claim 7, further including a water outlet port in said stem portion, a manually-operated diverter valve carried by said main body portion above said bottle, said body water inlet port forming the inlet of said valve, said valve having a first and a second valve outlet port, said first valve outlet port directly communicating with said bottle, said second valve outlet port communicating with the outlet port of said stem portion through a second tubing.

10. A portable apparatus as defined in claim 9, wherein said diverter valve includes a rotary spool for selectively communicating said water inlet port with either one of said first and second valve outlet ports.

11. A portable apparatus as defined in claim 10, further including a faucet connector and a second diverter valve having a valve body with an inlet connected to said faucet connector and two outlets, one of said two outlets for discharging water out of said valve body and a flexible tubing connected to the other one of said two outlets and to said water inlet port of said body.

12. A portable apparatus as defined in claim 5, wherein said nozzle has a series of orifices and further including an obturator movably mounted on said nozzle for adjustably obturating said orifices.

13. A portable apparatus as defined in claim 12, further including a flexible discharge nipple fitted on said nozzle.

14. A portable apparatus as defined in claim 13, further including a cannula releasably attached to said nozzle through said nipple and orientable relative to said nozzle and body first end by flexing said nipple.

* * * * *